US006572296B2

(12) United States Patent
Schrepf

(10) Patent No.: US 6,572,296 B2
(45) Date of Patent: Jun. 3, 2003

(54) CONTAINERS SIMULATING COLLAPSIBLE TUBES, PACKAGES INCLUDING SUCH CONTAINERS, AND METHODS OF MAKING THEM

(75) Inventor: Volker Schrepf, East Islip, NY (US)

(73) Assignee: Henlopen Manufacturing Co., Inc., Melville, NY (US)

( * ) Notice: Subject to any disclaimer, the term of this patent is extended or adjusted under 35 U.S.C. 154(b) by 0 days.

(21) Appl. No.: 10/135,584

(22) Filed: Apr. 30, 2002

(65) Prior Publication Data

US 2003/0077104 A1 Apr. 24, 2003

Related U.S. Application Data

(60) Provisional application No. 60/294,873, filed on May 31, 2001.

(51) Int. Cl.[7] ..... A46B 11/00; A45D 34/04

(52) U.S. Cl. ..... 401/122; 132/218; 401/127; 401/129; 401/184

(58) Field of Search ..... 401/129, 127, 401/126, 122, 156, 184, 183, 132, 133; 132/218; 222/94

(56) References Cited

U.S. PATENT DOCUMENTS 586,283 A * 7/1897 Cole ..... 401/129
3,393,962 A * 7/1968 Andrews ..... 401/132
3,584,211 A * 6/1971 Rauhut ..... 222/94 X
4,982,838 A * 1/1991 Fitjer ..... 401/129 X
6,039,487 A * 3/2000 Kristiansen ..... 401/129 X
6,062,757 A * 5/2000 Gueret ..... 401/122
6,158,912 A * 12/2000 Miraglia et al. ..... 401/129
6,474,890 B1 * 11/2002 Gueret ..... 401/122 X

* cited by examiner

*Primary Examiner*—Gregory Huson
*Assistant Examiner*—Kathleen J. Prunner
(74) *Attorney, Agent, or Firm*—Cooper & Dunham LLP

(57) ABSTRACT

A container for mascara or the like, including a substantially rigid hollow inner member with a large open end and a smaller closed end, and a surrounding flexible sleeve extending from the open end of the inner member beyond the closed end of the inner member to a closed and flattened extremity simulating the appearance of a tube of oil paint. A complete mascara package also includes a neck disposed at the end of the container and a cap mountable on the neck and bearing an applicator for insertion into the container through the neck. Methods for making the container include molding the hollow member and sleeve integrally of plastic, with the sleeve extremity initially open, and thereafter flattening and closing the sleeve extremity; and providing the hollow member and sleeve as separate elements, the sleeve being a flexible metal tube into which the hollow member is inserted.

22 Claims, 5 Drawing Sheets

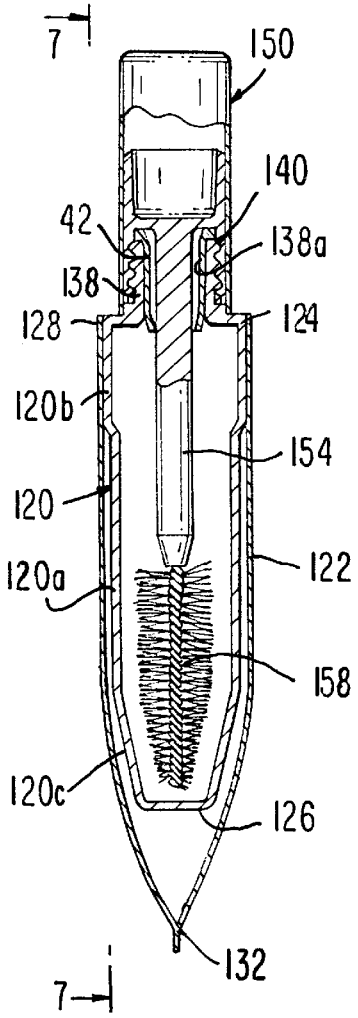
FIG. 5
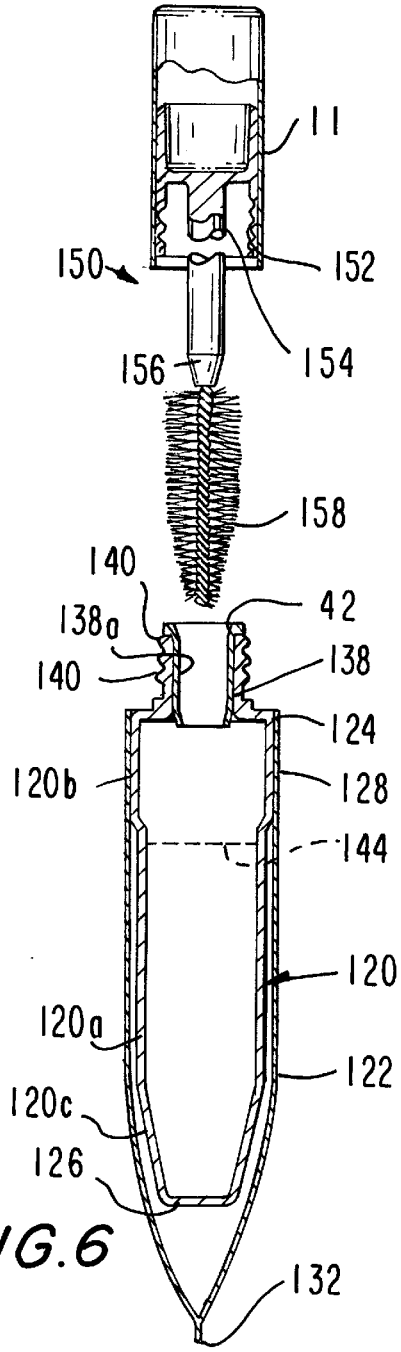
FIG. 6
FIG. 7
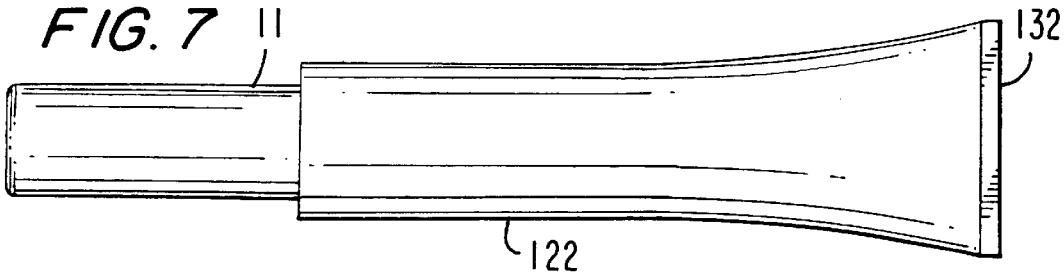

CONTAINERS SIMULATING COLLAPSIBLE TUBES, PACKAGES INCLUDING SUCH CONTAINERS, AND METHODS OF MAKING THEM

CROSS REFERENCE TO RELATED APPLICATION

This application claims the benefit of U.S. provisional application No. 60/294,873, filed May 31, 2001, under 35 U.S.C. §119(e).

BACKGROUND OF THE INVENTION

This invention relates to containers and packages for liquid materials which are removed therefrom in small quantities by an inserted applicator, and to methods of making such containers. More particularly, it relates to containers having an ornamental appearance simulating a collapsible tube such as an artist's tube of oil paint, yet capable of holding liquid material for removal by an inserted applicator, as well as to packages including such containers and methods of making them.

In a still more specific sense, the invention is directed to containers and packages for cosmetic materials of types exemplified by mascara, to which detailed reference will be made herein for purposes of illustration. The term "liquid material" will be understood to embrace highly viscous, thick and pasty material, e.g., containing dispersed or suspended solid ingredients such as colorants, as well as more readily flowable liquids.

In present-day commercial practice, mascara is commonly packaged in an elongated, rigid container having a threaded neck formed integrally at one end and closed by a cap. The combined length of the container and cap is not more than a few inches, and the cross-sectional dimension of the container is less than an inch, so that the container-cap package can easily be carried in a purse or pocket and held in a user's hand. A substantially rigid stem bearing an applicator such as a twisted-in-wire bristle brush at its extremity is carried by the cap so as to extend into the interior of the container, with the brush immersed in the contained mascara, when the cap is seated on the neck; and a flexible wiper element is mounted in the neck for wiping excess mascara from the brush as the brush is withdrawn through the neck.

To apply mascara from a conventional package as just described, the user holds the container in one hand while unscrewing and removing the cap with the other, withdrawing the brush from the container interior. The brush, carrying a quantity of the mascara in which it has been immersed, is manually transported into contact with the user's lashes so as to deposit the mascara on and comb it through the lashes, with the cap serving as a handle. This manipulative sequence of operations is repeated as necessary until a desired application of mascara to the lashes is complete. Thereafter the brush is re-inserted in the container through the neck, and the cap is tightened on the neck to effect liquid-tight closure of the container. The capacity of the container is sufficient to hold enough mascara for multiple applications.

In such a package, the internal configuration and dimensions of the mascara-holding container must accommodate the full length of the applicator brush and substantially rigid stem when the cap is threadedly seated on the neck, and must also be such that, as the body of contained mascara is progressively depleted by repeated removal of small quantities on the brush, the remaining mascara continues to be in contact with the inserted brush, to minimize waste of product. These considerations, as well as the importance of small size for portability and ease of manipulation, constrain the design of the container.

Typically, a mascara container of the described type is a unitary molded rigid single-walled plastic body of elongated cylindrical shape with a flat closed end, although containers of noncircular (e.g., more or less square) external cross-section are also known. While diversity and novelty in appearance are desirable attributes of mascara packaging (and of cosmetic packaging generally), heretofore variation in aesthetic aspects of mascara container design has generally involved provision of or changes in external surface appearance (colors, imprints, patterns) and/or superimposed ornamentation (applied relief elements such as metal bands), without substantially disguising or modifying the characteristic overall configuration of a conventional mascara container.

SUMMARY OF THE INVENTION

An object of the present invention is to provide innovative designs for containers and packages for liquid material products that are to be removed from such containers in small quantities by an inserted applicator. Another object is to provide such designs through the simulation of well-known containers conventionally identified with other types of products themselves having associations with the fine arts.

A more particular object is to provide such containers simulating collapsible tubes conventionally used for artists' oil paints, as well as methods of making them. In important illustrative embodiments, these containers have utility for cosmetic materials, exemplified by mascara.

Yet another specific object is to provide mascara packages including containers simulating artists' oil paint tubes.

To these and other ends, the present invention in a first broad aspect contemplates the provision of a container for liquid material which is to be removed therefrom in small quantities by an applicator, the container comprising a substantially rigid, hollow inner member having an open proximal end, a closed distal end smaller in cross-sectional area than the proximal end, and an axial length therebetween, the inner member tapering progressively toward the distal end over at least part of its length; and a flexible sleeve with an axial length greater than that of the inner member, laterally surrounding the inner member and having a first end adjacent the proximal end of the inner member and a closed and flattened second end disposed distally of the distal end of the inner member, simulating the appearance of a collapsible tube of oil paint or the like.

The container typically or preferably has a neck fixedly disposed in the proximal end of one of the inner member and the sleeve, the neck being engageable by a closure member and having a central passage through which an applicator, carried by the closure member, is insertable into the interior of the container for transporting a quantity of contained liquid material therefrom.

In particular embodiments of the invention, the inner member is a substantially rigid, hollow container member for holding a body of liquid material, the container member having an open proximal end, a closed distal end smaller in cross-sectional area than the proximal end, and an axial length therebetween, the container member tapering progressively toward the distal end over at least part of its length; and the first end of the flexible sleeve is secured to the proximal end of the container member. In these embodiments the container typically or preferably has a neck (as described above) fixedly disposed in the open proximal end of the container member.

As used herein, the terms "proximal" and "distal" refer, respectively, to the end of the container at which the neck is located, and the end of the container remote therefrom, and to the corresponding directions along the long geometric axis of the container.

In certain embodiments of the invention, the container member and the sleeve are integrally molded of plastic, the second end of the sleeve being open when molded and being subsequently flattened and closed. The neck in these embodiments may be an initially separate member mounted in the open proximal end of the container member. A method in accordance with the invention for making the container includes the steps of integrally molding the container member and the sleeve of plastic, the second end of the sleeve being open when molded; and subsequently flattening and closing the second end of the sleeve.

In other embodiments of the invention, the sleeve is a flexible metal tube with a closed and flattened second end and an open first end into which the container member is inserted until the proximal end of the container member is pressed into the first end of the sleeve. A method in accordance with the invention for making a container of this type includes the steps of providing the container member and the sleeve as initially separate elements, the sleeve being a flexible metal tube with a closed and flattened second end and an open first end; and inserting the container member, distal end first, into the open end of the sleeve until the proximal end of the container member is pressed into the first end of the sleeve. The container member and the neck, in such case, may be integrally molded of plastic.

A still further embodiment of the invention comprises a thin walled flexible metal tube with an integral metal neck sized to accept a mascara wiper and mate with a conventional screw-on cap and mascara applicator, and, as the inner member, a molded plastic crush shield with an open proximal end. Initially the tube is open at its distal end, and to assemble the container, the crush shield is inserted (open proximal end first) into the tube through this open distal end. The distal end of the tube is then flattened, folded and crimped so as to mimic an artist's oil paint tube. The geometry of the crush shield is such that it follows the normally resulting contours of a filled paint tube.

The invention in a further aspect contemplates the provision of a package for liquid material comprising a container including an inner member, flexible sleeve, and neck, all as described above, wherein the container holds a body of liquid material; a closure member engageable with the neck; and an applicator carried by the closure member and insertable into the interior of the container for transporting a quantity of the contained liquid material therefrom, the inner member having internal dimensions and configuration for accommodating the applicator therewithin when the closure member engages the neck. The applicator, in certain embodiments of this package, comprises a stem projecting distally from the closure member and having a distal end, and a brush mounted at the distal end of the stem.

More particularly, the invention embraces the provision of a package as described wherein the liquid material is mascara and the applicator is an applicator for mascara.

In the container of the invention, the simulated appearance of an artist's tube of oil paint is achieved both by the flattening of the second end of the flexible sleeve at the distal extremity thereof, and by the effect of the rigid inner member in filling out the proximal portion of the sleeve, which resembles the way a contained body of oil paint fills out the corresponding portion of an artist's paint tube. The distal tapering of at least a portion of the rigid container member contributes to this simulation.

It will be understood that by "collapsible tube" is meant a tube, such as is conventionally used to package artists' oil paints, which has a crimped straight closed distal end and a flexible wall initially filled out along at least most of its length by contained product (oil paint). As the paint is squeezed from the tube by manual pressure on the tube wall adjacent the distal end, the tube progressively collapses (becomes flattened), from the distal to the proximal end thereof.

An artist's oil paint tube has pleasing associations with culture, creativity, and fine arts, so that a cosmetic package simulating its appearance has enhanced appeal for the consumer and affords consequent benefits from a marketing standpoint. However, a collapsible tube in itself is unsuitable as a container for a product, such as mascara, that is removed from the container and applied with a mascara brush (or like applicator implement) repeatedly inserted in the container to remove successive small quantities of product. The applicator, an axially extended and substantially rigid element projecting from the cap, must be fully received within the container to enable the cap to close the container, regardless of how full or empty the container may be; the progressive flattening of a collapsible tube that occurs as product is depleted would interfere with this requisite insertion. The present invention overcomes this difficulty by providing a rigid inner member of invariant internal dimensions for holding the product and receiving the applicator, while surrounding the inner member with a flexible sleeve that is distally flat but otherwise filled out by the inner member so as to look like an artist's paint tube.

Further features and advantages of the invention will be apparent from the detailed description hereinbelow set forth, together with the accompanying drawings.

BRIEF DESCRIPTION OF THE DRAWINGS

FIG. 5 is an enlarged assembled sectional elevational view, again from the same direction as FIG. 3, of a package incorporating another structural embodiment of the container of the invention;

FIG. 6 is a similarly enlarged sectional elevational view of the package of FIG. 5, showing the cap and applicator removed from the container;

FIG. 7 is an external side elevational view of the package of FIG. 5, taken as along the line 7—7 of FIG. 5;

DETAILED DESCRIPTION

The invention will be described, with reference to the drawings, as embodied in containers for and packages of mascara, although it will be understood that in its broader aspects the invention is not limited thereto.

Figure 1:
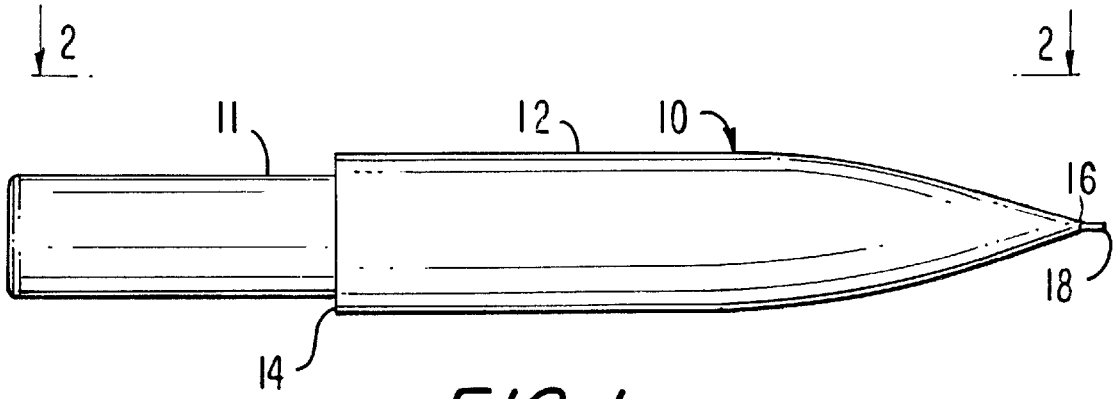
FIG. 1 is an enlarged side elevational view of a liquid material package, including a container, embodying the present invention in a particular form.
Figure 2:
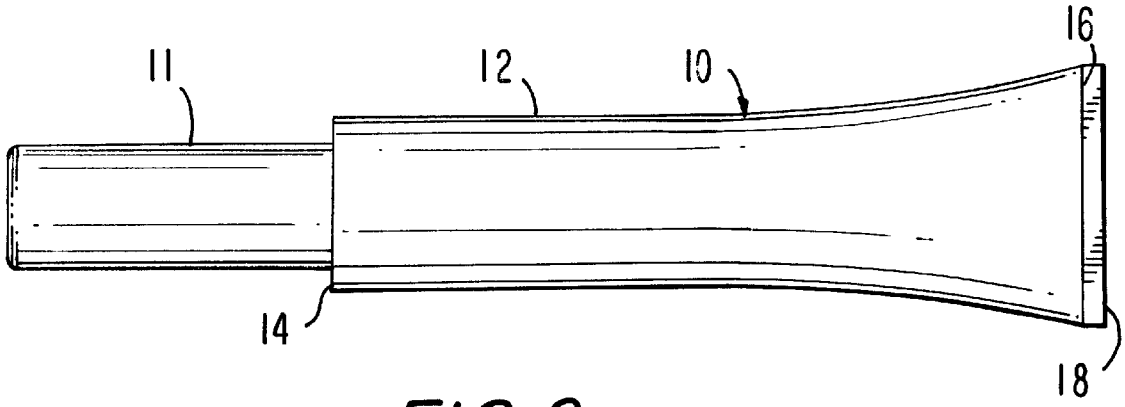
FIG. 2 is another, similarly enlarged side elevational view of the same container, taken as along the line 2—2 of FIG. 1.

FIGS. 1 and 2 illustrate a typical mascara package embodying the invention. As there shown, the package comprises an elongated container 10 and a cap 11 disposed at one end of the container. In external appearance, the container 10 resembles a tube of artist's oil paint, having a generally filled-appearing, rounded (e.g., conical or cylindrical) proximal portion 12 extending from a first (proximally located) end 14, and a flattened second (distally located) end 16 with a crimped extremity 18. As viewed from a first side direction, represented by FIG. 1, the container tapers from the proximal portion 12 to the extremity 18. As viewed from a second side direction at 90° to the first, represented by FIG. 2, the container flares from the proximal portion 12 to the crimped extremity, which extends along a straight line perpendicular to the longitudinal geometric axis of the container. This configuration simulates a flexible-walled collapsible paint tube in which the proximal portion of the tube is filled out to a substantially rounded or cylindrical shape by the contained paint, while the distal extremity of the tube is pinched into a straight crimped extremity.

The cap 11, as shown, may be an externally cylindrical element smaller in diameter than the proximal portion of the container 10 and of sufficient axial length to serve conveniently as a handle for manipulation of an applicator such as a mascara brush (not illustrated in FIGS. 1 and 2) that extends from the cap into the container interior when the cap is in closed position on the container. The container, in this embodiment, has an externally threaded neck (not shown in FIGS. 1 and 2) projecting proximally from the proximal end 14, on which the cap seats threadedly to provide liquid-tight closure.

Figure 3:
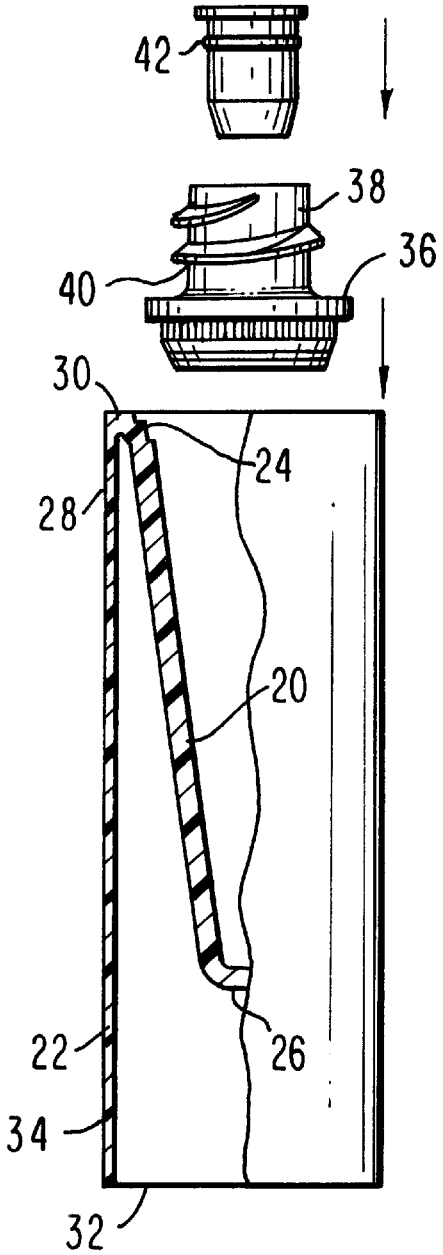
FIG. 3 is an exploded enlarged elevational view, taken from the same direction as FIG. 1, and partly in section, of a specific structural embodiment of the container of the invention.
Figure 10:
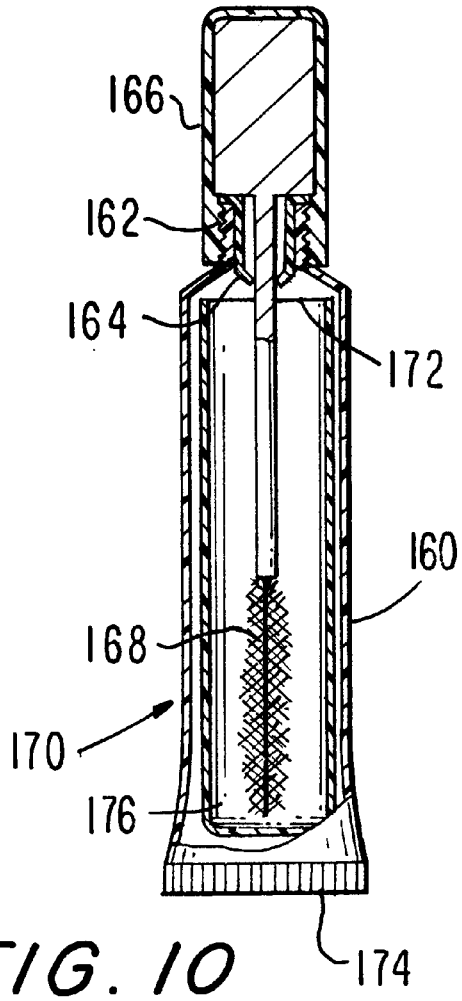
FIG. 10 is a sectional elevational view taken as along the line 10—10 of FIG. 9.

A first specific embodiment of the container of the invention is shown in FIGS. 2 and 3. This container is a one-piece plastic injection molded structure constituted of a substantially rigid hollow inner container member 20 for holding a body of mascara (not shown in FIGS. 3 and 4) and a flexible, thin-walled tubular outer sleeve 22 which laterally surrounds the container member over the entire length thereof. The container member is of elongated conical configuration, having a maximum diameter at its open, circular proximal end 24 and tapering therefrom to a closed distal end 26 of much smaller diameter (the conical configuration can be varied so as to increase container capacity, by reconfiguring the closed distal end of the container so that as shown in FIG. 10 it mimics, without the flair, the tubular outer sleeve 22 when it is flattened and secured). The sleeve 22, which is longer than the container member 20, has a circular first end 28 molded integrally with a circumferential flange 30 formed at the proximal end 24 of container member 20, and an initially open and circular free second end 32; being longer than the container member, the sleeve extends distally beyond the closed distal end of the container member to the second end 32.

The exploded view of FIG. 3 shows the container in as-molded condition in which, as stated, the second end 32 of the thin flexible sleeve is open, so as to enable the container member and sleeve to be molded as a unit with their respective proximal and first ends joined at flange 30. After molding, the distal portion 34 of the sleeve is collapsed or pinched to flatten the free second end 32 of the sleeve, which is then adhered to itself in any suitable manner (for example, bonded with heat) to form a crimped, flattened extremity as shown at 32*a* in FIG. 4, i.e., having the shape and appearance of the crimped extremity 18 illustrated in FIGS. 1 and 2.

Figure 4:
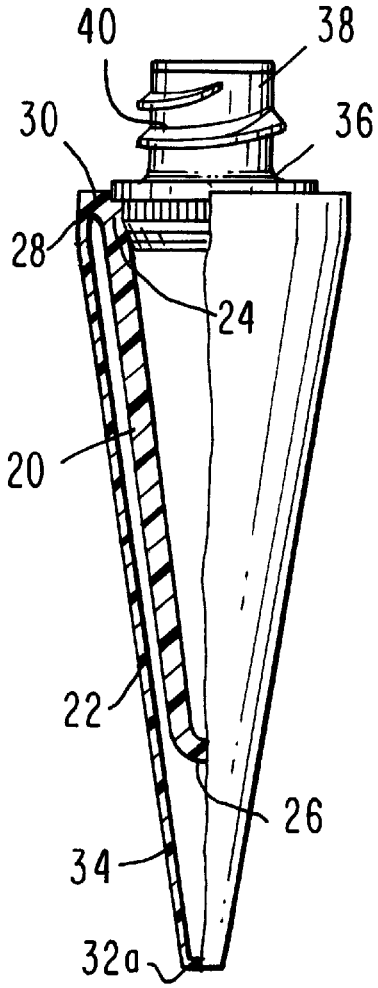
FIG. 4 is a similarly enlarged assembled view, taken from the same direction as FIG. 3 and partly in section, of the container of FIG. 3.
Figure 8:
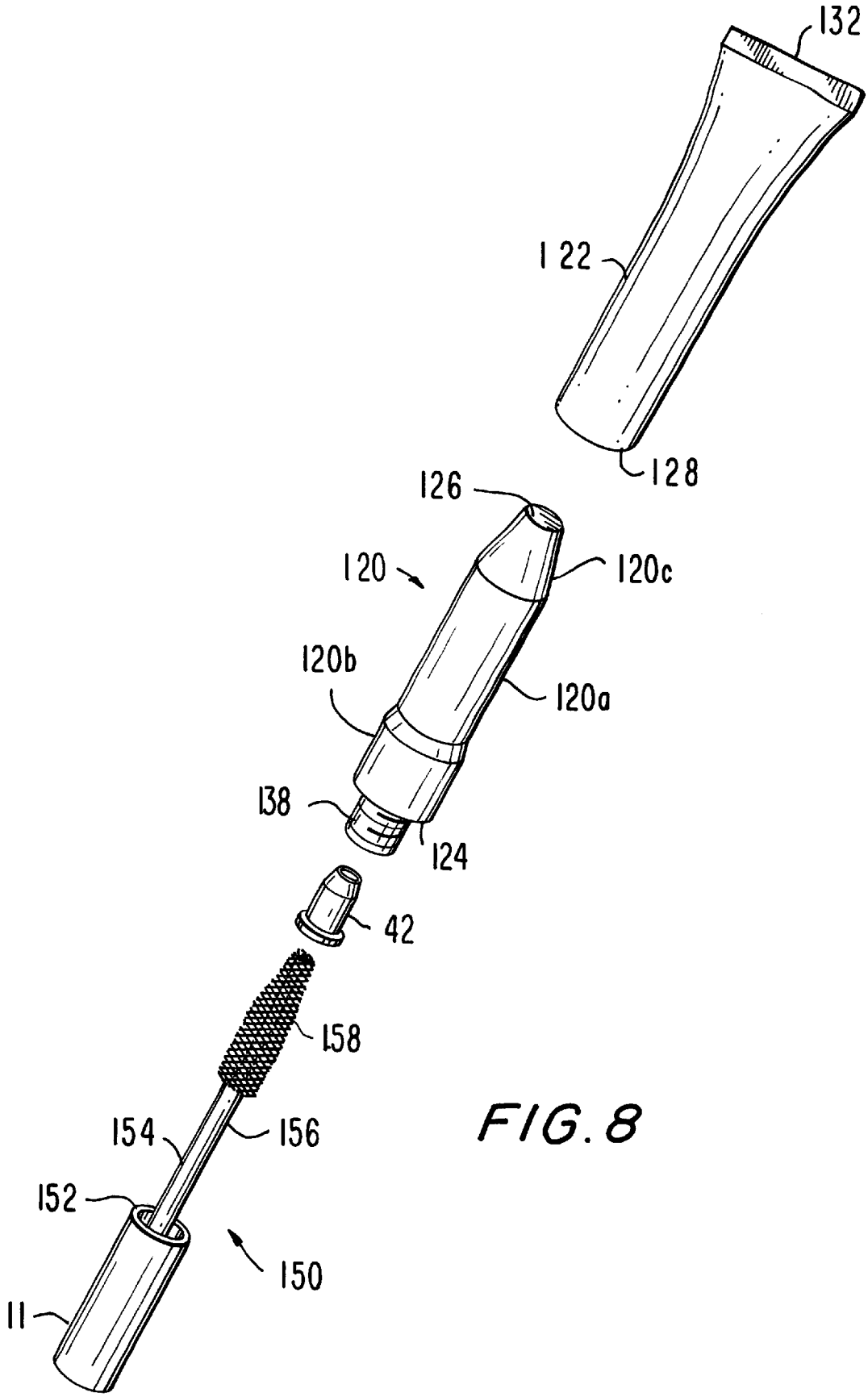
FIG. 8 is an enlarged exploded perspective view of the package of FIG. 5.
Figure 9:
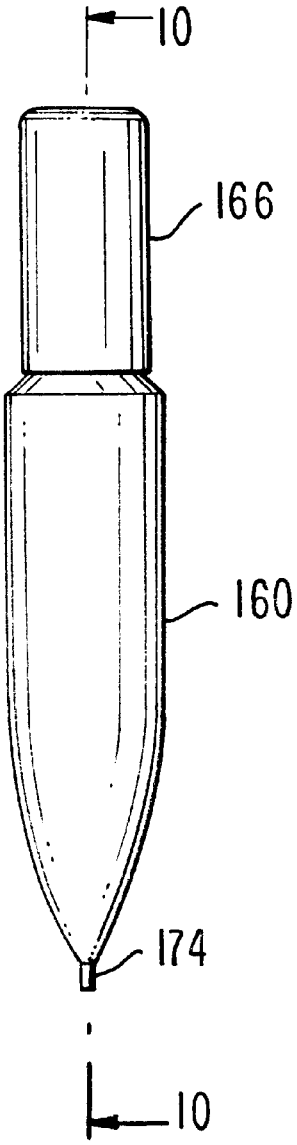
FIG. 9 is an external side elevational view of another embodiment of the invention.

The one-piece combined sleeve and container member of FIGS. 3 and 4 may be injection molded of polypropylene, with the sleeve wall being sufficiently thin (e.g. 0.015 inch thick) to allow the sleeve to be flexed with normal finger pressure, and to be collapsed and crimped distally as described above. The wall thickness of the inner container member 20 is sufficient to resist collapse and to retain its initial shape and cross-sectional dimensions as it is emptied; i.e., the container member is self-sustaining in shape. When the distal extremity of the sleeve is flattened and crimped, the inner container fills out the proximal portion of the sleeve so that the sleeve simulates the appearance of a filled tube of artist's oil paint, whether or not the container member itself is filled with mascara.

A substantially rigid plastic (e.g. polypropylene) neck element 36, molded separately from the sleeve-container member unit, is mounted in the proximal end 24 of the container member and sealingly bonded thereto. The element 36 defines a through passage (not shown) coaxial with the container member, and includes a cylindrical neck portion 38 smaller in diameter than the proximal end of the container member and bearing a molded external thread 40. A generally conventional wiper member 42, molded (for example) of low density polyethylene, may be inserted and mounted in the through passage of the neck.

The container of FIGS. 3–4 is used with a cap and applicator unit, e.g., of conventional type including a screw-on cap with a projecting applicator stem bearing at its distal end an applicator such as a twisted-in-wire mascara brush, all as further described below with reference to FIGS. 5 and 6.

A second embodiment of the container of the invention, incorporated in a mascara package, is illustrated in FIGS. 5–8. In this embodiment, the container member 120 is a rigid molded hollow plastic member laterally surrounded by a thin-walled, flexible (i.e., collapsible) tubular metal sleeve 122. The container member 120 and sleeve 122 are initally seperate elements. The container member is circular in cross-section throughout and is axially elongated, extending from a proximal end 124 of maximum diameter to a closed distal end 126 of minimum diameter; it has a cylindrical central portion 120*a,* a proximal portion 120*b* which is also cylindrical but enlarged in diameter relative to the central portion, and a frustoconical distal portion 120*c* tapering distally from the central portion to the distal end 126. The frustoconical configuration can also be varied to increase capacity as mentioned above with reference to the first-described embodiment and illustrated in FIG. 10.

At its proximal end 124, the container member has a reduced-diameter neck portion 138 formed integrally therewith and projecting proximally therefrom, the neck portion defining a through passage 138*a* and having a molded external thread 140. A wiper element, such as the wiper member 42 described above, is press-fitted into the neck passage 138*a*.

The collapsible metal sleeve 122 is longer than the container member, with an open first or proximal end 128 and a closed (e.g. crimped) and flattened second or distal end 132. It is sufficiently large in internal diameter to receive, snugly, the enlarged proximal portion 120*b* of the container member. To assemble the container of FIGS. 5–8, the container member 120 is inserted, distal end first, into the open first end 128 of the sleeve 122, until the proximal end 124 of the container member is in register with the sleeve first end 128. The proximal portion 120*b* of the container member is thus press-fitted into the sleeve, whereby the sleeve is securely attached to the container member as shown in FIGS. 5 and 6.

Since the sleeve 122 is longer than the container member 120, the sleeve in the assembled container extends beyond the distal end 126 of the container member; i.e., the crimped and flattened second end 132 of the sleeve (which again has the shape of extremity 18 in FIGS. 1 and 2) lies distally beyond the tapering distal portion 120*c* of the container member, while the container member fills out the proximal portion of the sleeve so that the external appearance of the container simulates a tube of artist's oil paint.

In each of the embodiments of FIGS. 3–4 and 5–8, the container member is filled with a body of mascara (indicated by broken line 144 in FIG. 6) and is combined with a cap-and-applicator unit 150 (FIGS. 5–8) to constitute a complete mascara package. The unit 150 may itself be conventional, including a cylindrical cap 11 having a hollow, open, internally threaded distal end 152 for threadedly engaging and seating on the neck portion 38 or 138 of the container. An elongated applicator stem 154 projects distally from and beyond the interior of the cap and bears, at its free distal end 156, a twisted-in-wire mascara brush 158 or other suitable applicator.

The dimensions of the stem and brush combination and the container member are such that, when the cap is fully threadedly seated on the neck portion of the container so as to provide liquid-tight closure of the container, the stem extends into the interior of the hollow container member and the tip of the brush reaches almost to the floor or distal end of the container member interior.

The containers and packages of the invention, as exemplified by mascara dispensers, are used in the same manner as wholly conventional mascara dispensers. Initially the container member is substantially filled with mascara and the cap is tightly seated on the neck portion to close the container; the stem extends through the wiper and the brush is immersed in the contained mascara. To apply mascara, the user unscrews the cap and, employing the cap as a handle, withdraws the stem and brush from the container; the brush carries mascara on its bristles, excess mascara being removed from the bristles as the brush passes through the wiper. After application, the brush is reinserted in the container, either to pick up additional mascara or, if no further application is required, for closure of the container.

As will be apparent, the invention provides a container and package simulating the appearance of an artist's collapsible tube of oil paint in having a flattened and crimped distal end and a "filled" or rounded proximal portion, yet owing to the substantial rigidity of the inner container member 20 or 120, the container accommodates with clearance a cap-stem-brush unit (or other cap-applicator unit) regardless of how full or empty the container may be, whereas if the mascara were contained in an actual collapsible tube, the progressive flattening of the tube as the product is depleted would prevent insertion and use of the brush or other applicator.

Still another embodiment of the invention, again shown as a mascara container, is illustrated in FIG. 10. In this container, the sleeve is a thin walled flexible metal tube 160 with an integral metal neck 162 sized to accept a mascara wiper 164 and mate with a conventional screw-on cap 166 and mascara applicator 168. The inner member is a crush shield 170, molded of a hard compatible plastic polymer, with an open proximal end 172. Initially the tube is open at its distal end 174, and the crush shield is inserted (open proximal end first) into the tube through this open distal end. The distal end of the tube is then flattened, folded and crimped so as to mimic an artist's oil paint tube. The geometry of the crush shield is such that it follows the normally resulting contours of a filled paint tube, i.e., it is configured distally to conform to the inside contours of the crimped tube, as indicated at 176.

It is to be understood that the invention is not limited to the features and embodiments herein specifically set forth, but may be carried out in other ways without departure from its spirit.

What is claimed is:

1. A container for liquid material which is to be removed therefrom in small quantities by an applicator, comprising:

(a) a substantially rigid, hollow inner member having an open proximal end, a closed distal end smaller in cross-sectional area than the proximal end, and an axial length therebetween, the inner member tapering progressively toward the distal end over at least part of its length; and (b) a flexible sleeve with an axial length greater than that of the inner member, laterally surrounding the inner member and having a first end adjacent the proximal end of the inner member and a closed and flattened second end disposed distally of the distal end of the inner member, simulating the appearance of a collapsible tube of oil paint.

2. A container as defined in claim 1, wherein the liquid material is contained in the inner member and further including a neck fixedly disposed in the open proximal end of the inner member, the neck being engageable by a closure member and having a central passage through which the applicator, being carried by the closure member, is insertable into the interior of the inner member for transporting a quantity of the contained liquid material therefrom.

3. A container as defined in claim 2, wherein the sleeve is a thin walled flexible metal tube having the second end forming an initially open distal end, said neck is a metal neck integral with the tube, and the inner member is a molded plastic crush shield, the container being assembled by inserting the crush shield, proximal end first, into the open distal end of the tube, and then flattening, folding and crimping the distal end of the tube.

4. A container as defined in claim 1, wherein the inner member is a container member for holding a body of the liquid material and the first end of the flexible sleeve is secured to the proximal end of the container member.

5. A container as defined in claim 4, further including a neck fixedly disposed in the open proximal end of the container member, the neck being engageable by a closure member and having a central passage through which the applicator, being carried by the closure member, is insertable into the interior of the container member for transporting a quantity of the contained liquid material therefrom.

6. A container as defined in claim 4, wherein the container member and the sleeve are integrally molded of plastic, the second end of the sleeve being open when molded and being subsequently flattened and closed.

7. A container as defined in claim 6, further including a neck fixedly disposed in the open proximal end of the container member, the neck being engageable by a closure member and having a central passage through which the applicator, being carried by the closure member, is insertable into the interior of the container member for transporting a quantity of the contained liquid material therefrom; and wherein the neck is an initially separate member mounted in the open proximal end of the container member.

8. A container as defined in claim 4, wherein the sleeve is a flexible metal tube into which the container member is inserted until the proximal end of the container member is pressed into the first end of the sleeve.

9. A container as defined in claim 8, further including a neck fixedly disposed in the open proximal end of the container member, the neck being engageable by a closure member and having a central passage through which the applicator, being carried by the closure member, is insertable into the interior of the container member for transporting a quantity of the contained liquid material therefrom; and wherein the container member and the neck are integrally molded of plastic.

10. A package for liquid material, comprising:

(a) a container holding a body of liquid material and including (i) a substantially rigid, hollow inner member having an open proximal end, a closed distal end smaller in cross-sectional area than the proximal end, and an axial length therebetween, the inner member tapering progressively toward the distal end over at least part of its length;

(ii) a flexible sleeve with an axial length greater than that of the inner member, laterally surrounding the inner member and having a first end adjacent the proximal end of the inner member and a closed and flattened second end disposed distally of the distal end of the inner member, simulating the appearance of a collapsible tube of oil paint; and (iii) a neck fixedly disposed in the open proximal end of the inner member and having a central passage;

(b) a closure member engageable with the neck; and (c) an applicator carried by the closure member and insertable into the interior of the inner member for transporting a quantity of the contained liquid material therefrom, the inner member having internal dimensions and a configuration for accommodating the applicator therewithin when the closure member engages the neck.

11. A package as defined in claim 10, wherein the inner member is a container member holding the body of liquid material, the first end of the flexible sleeve is secured to the proximal end of the container member.

12. A package as defined in claim 11, wherein the applicator comprises a stem projecting distally from the closure member and having a distal end, and a brush mounted at the distal end of the stem.

13. A package as defined in claim 10, wherein the sleeve is a thin walled flexible metal tube having the second end forming an initially open distal end, said neck is a metal neck integral with the tube, and said inner member is a molded plastic crush shield, the container being assembled by inserting the crush shield, proximal end first, into the open distal end of the tube, and then flattening, folding and crimping the distal end of the tube.

14. A mascara package comprising:

(a) a container holding a body of mascara and including (i) a substantially rigid, hollow inner member having an open proximal end, a closed distal end smaller in cross-sectional area than the proximal end, and an axial length therebetween, the inner member tapering progressively toward the distal end over at least part of its length;

(ii) a flexible sleeve with an axial length greater than that of the inner member, laterally surrounding the inner member and having a first end adjacent the proximal end of the inner member and a closed and flattened second end disposed distally of the distal end of the inner member, simulating the appearance of a collapsible tube of oil paint and (iii) a neck fixedly disposed in the open proximal end of the inner member and having a central passage;

(b) a closure member engageable with the neck; and (c) an applicator carried by the closure member and insertable into the interior of the inner member for transporting a quantity of the contained mascara therefrom, the inner member having internal dimensions and a configuration for accommodating the applicator therewithin when the closure member engages the neck.

15. A package as defined in claim 14, wherein the inner ember is a container member holding the body of mascara, the first end of the flexible sleeve is secured to the proximal end of the container member.

16. A package as defined in claim 15, further including a wiper element mounted in the neck for removing excess mascara from the applicator when the applicator is withdrawn from the container interior through the neck passage.

17. A package as defined in claim 15, wherein the container member and the sleeve are integrally molded of plastic, the second end of the sleeve being open when molded and being subsequently flattened and closed; and wherein the neck is an initially separate member mounted in the open proximal end of the container member.

18. A package as defined in claim 15, wherein the sleeve is a flexible metal tube into which the container member is inserted until the proximal end of the container member is pressed into the first end of the sleeve; and wherein the container member and the neck are integrally molded of plastic.

19. A package as defined in claim 14, wherein the sleeve is a thin walled flexible metal tube having the second end forming an initially open distal end, said neck is a metal neck integral with the tube, and said inner member is a molded plastic crush shield, the container being assembled by inserting the crush shield, proximal end first, into the open distal end of the tube, and then flattening, folding and crimping the distal end of the tube.

20. A method of making a container for liquid material which is to be removed therefrom in small quantities by an applicator, the container including a substantially rigid, hollow container member for holding a body of liquid material, the container member having an open proximal end, a closed distal end smaller in cross-sectional area than the proximal end, and an axial length therebetween, the container member tapering progressively toward the distal end over at least part of its length; and a flexible sleeve with an axial length greater than that of the container member, laterally surrounding the container member and having a first end secured to the proximal end of the container member and a closed and flattened second end disposed distally of the distal end of the container member, simulating the appearance of a collapsible tube of oil paint; said method comprising:

(a) integrally molding the container member and the sleeve of plastic, the second end of the sleeve being open when molded; and (b) subsequently flattening and closing the second end of the sleeve.

21. A method of making a container for liquid material which is to be removed therefrom in small quantities by an applicator, the container including a substantially rigid, hollow container member for holding a body of liquid material, the container member having an open proximal end, a closed distal end smaller in cross-sectional area than the proximal end, and an axial length therebetween, the container member tapering progressively toward the distal end over at least part of its length; and a flexible sleeve with an axial length greater than that of the container member, laterally surrounding the container member and having a first end secured to the proximal end of the container member and a closed and flattened second end disposed distally of the distal end of the container member, simulating the appearance of a collapsible tube of oil paint; said method comprising:

(a) providing the container member and the sleeve as initially separate elements, the sleeve being a flexible metal tube with the first end being open; and (b) inserting the container member, distal end first, into the open end of the sleeve until the proximal end of the container member is pressed into the first end of the sleeve.

22. A method of making a container for liquid material which is to be removed therefrom in small quantities by an applicator, the container including a substantially rigid, hollow crush shield having an open proximal end, a distal end smaller in cross-sectional area than the proximal end, and an axial length therebetween, the crush shield tapering progressively toward the distal end over at least part of its length; and a flexible sleeve with an axial length greater than that of the crush shield, laterally surrounding the crush sheild and having a first proximal end and a closed and flattened second end disposed distally of the distal end of the crush shield, simulating the appearance of a collapsible tube of oil paint; said method comprising:

(a) providing the crush shield and the sleeve as initially separate elements, the sleeve being a flexible metal tube having the proximal end provided with an integral metal neck and the second end forming an initially open distal end, (b) inserting the crush shield, proximal end first, into the open distal end of the tube, and (c) flattening, folding and crimping the distal end of the tube.

* * * * *